US005799621A

United States Patent [19]

Gordon et al.

[11] Patent Number: 5,799,621

[45] Date of Patent: Sep. 1, 1998

[54] BOILER ASSEMBLY

[75] Inventors: Michael W. Gordon, Manheim; Robert Young, Millersville; Michael Zlatkin, Lancaster; Kurt D. Oswald, Hellam, all of Pa.

[73] Assignee: Burnham Corporation, Lancaster, Pa.

[21] Appl. No.: 757,021

[22] Filed: Nov. 26, 1996

[51] Int. Cl.[6] ..... F22B 23/06

[52] U.S. Cl. ..... 122/367.1; 122/209.1

[58] Field of Search ..... 122/367.1, 235.32, 122/235.34, 240.1, 240.2, 209.1

[56] References Cited

U.S. PATENT DOCUMENTS 2,206,398 7/1940 Grimm .
2,273,453 2/1942 Vandenberg .
4,126,105 11/1978 Böttcher et al. .
5,049,324 9/1991 Morris et al. .
5,353,749 10/1994 Seibel et al. .

*Primary Examiner*—Harold Joyce
*Assistant Examiner*—Gregory A. Wilson
*Attorney, Agent, or Firm*—Howson and Howson

[57] ABSTRACT

A boiler assembly having a unique burner box construction and a modular heat exchanger. The burner box has a primary diffuser upstream from a plurality of burners for evenly distributing a flow of air to and around the burners. The burner box also has a secondary diffuser downstream from the burners for mixing the fuel-air mixture exiting the burners with the air which flowed around the burners to create a final fuel-air mixture which can sustain stable and quiet combustion. The heat exchanger comprises a plurality of sections which define passageways for the combustion gases and circulating fluid. Reticulated ceramic cylinders are located within some of the combustion gas passageways immediately downstream of the burners to enhance heat transfer.

21 Claims, 6 Drawing Sheets

FIG. 2A
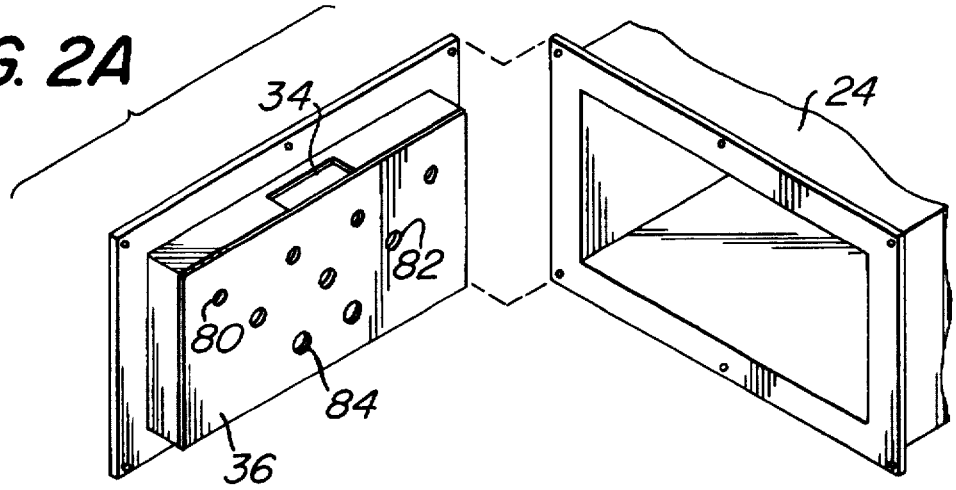
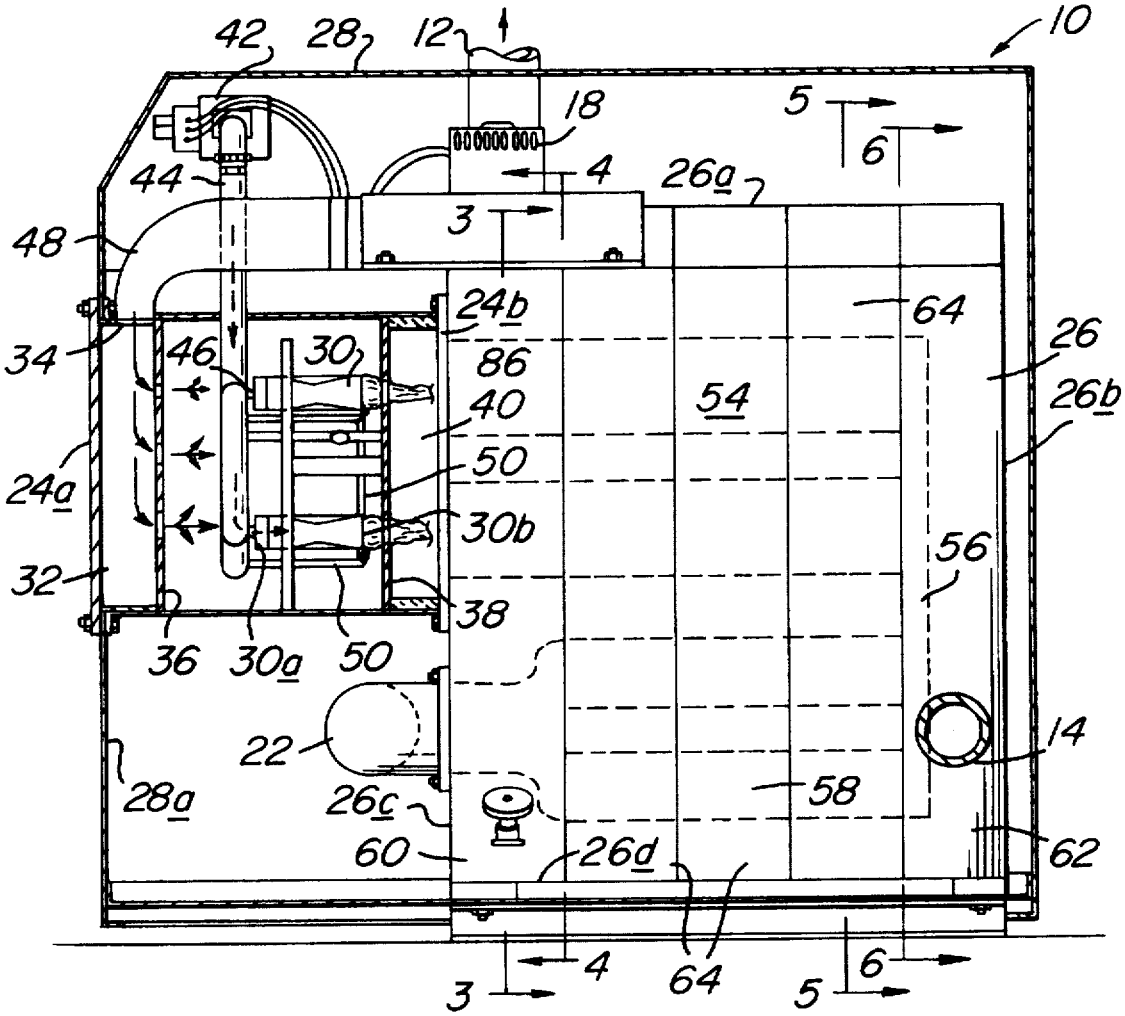
FIG. 2

FIG. 5
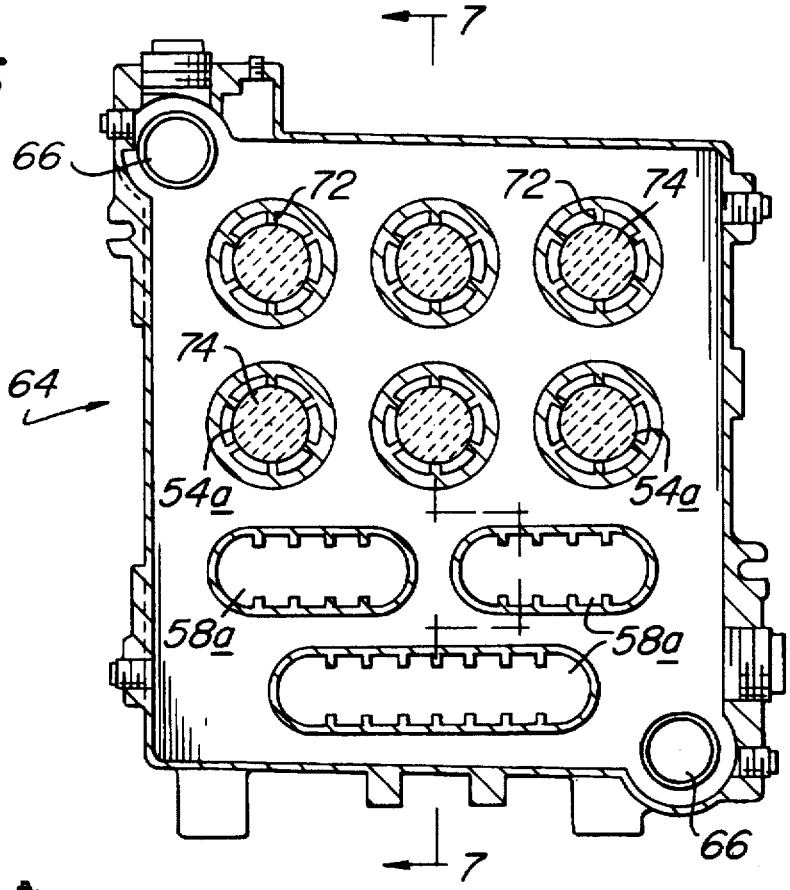
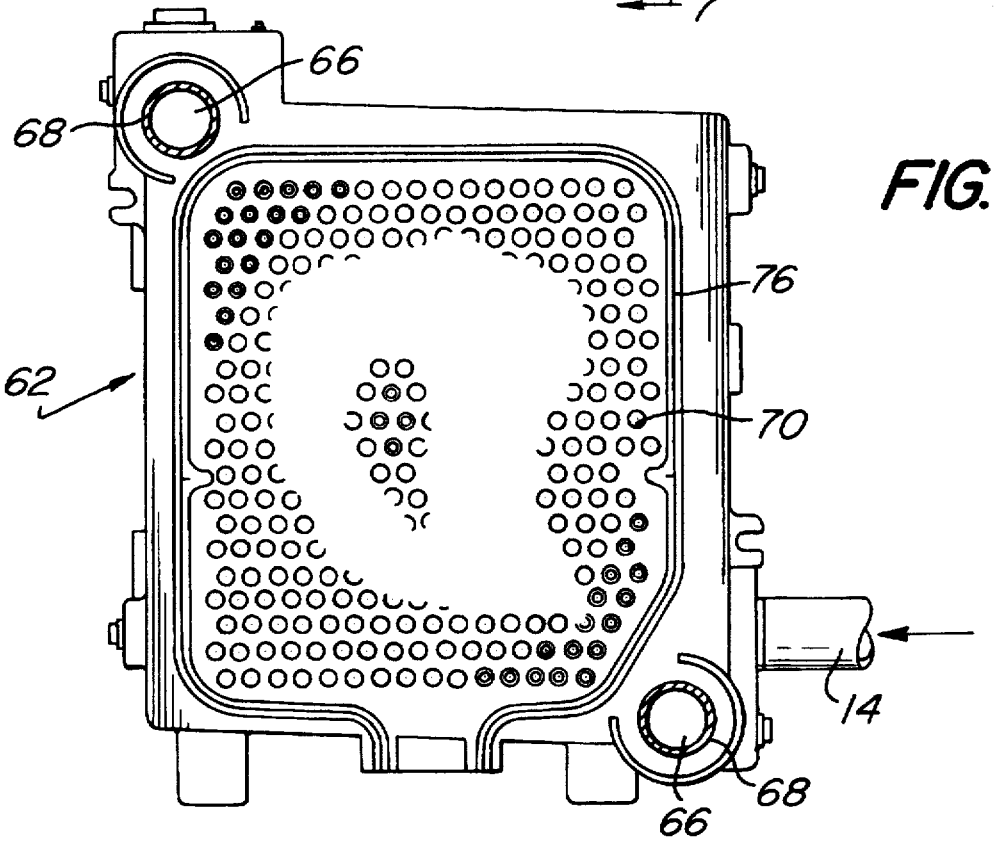
FIG. 6

BOILER ASSEMBLY

FIELD OF THE INVENTION

The present invention relates generally to residential and commercial sized boilers, and more particularly to a self-contained modular boiler having a unique burner and heat exchanger assembly which provide a compact, efficient and readily installable boiler unit having a range of heating capacities.

BACKGROUND OF THE INVENTION

A boiler is an integral part of a heating system of a building structure, or house, and is used to heat water circulating at high temperatures through hydronic piping and radiator/convector systems. The circulated water is completely isolated from the outside environment. Gaseous fuels are ignited within the boiler to generate heat which is transferred to the circulating water. The spent gas is exhausted into the atmosphere. The heated water exits the boiler, transfers the heat throughout the building, and returns to the boiler for re-heating.

Several criteria are taken into account in the design of a boiler. Generally, the size of the boiler is in direct relation to the size of the space to be heated. In turn, the size of the boiler has a direct relationship on the cost of manufacture, installation, and operation of the boiler. Operation and maintenance costs are also affected by the thermal stresses within the boiler structure. The size of the boiler also has an effect on the building space required to house the boiler assembly.

Another design criteria is the requirement of transferring energy efficiently from the combustion gases to the circulating water. Efficient heat transfer allows the use of lower combustion temperatures and provides lower exhaust gas temperatures. Reducing the combustion temperature also reduces the amount of noxious emissions, such as NOx and CO.

A further design criteria is the requirement for the burner to optimize combustion of the gaseous fuel. The burner should sustain quiet, stable combustion so that the heated air is evenly distributed for enhancing heat exchange and fuel efficiency.

Some of these design criteria are exemplified in the boiler disclosed in U.S. Pat. No. 2,206,398 issued to Grimm. The Grimm boiler assembly includes a hollow front section, a hollow rear section, and one or more hollow intermediate sections which are filled with circulating water and allow the water to pass therethrough. Hot air is forced into passages in the boiler. The hot air horizontally traverses the length of the boiler five times before being exhausted through a flue. A plurality of heat extruders, or fins, are located along the hot gas passageways to maximize heat transfer from the hot gases through the metal of the sections to the circulating water.

Other prior art patented boilers include U.S. Pat. No. 2,273,453 issued to Vandenberg which discloses a boiler assembled from a plurality of vertically aligned hollow sections. Adjacent sections are connected by hollow nipples which interconnect the water passageways between the sections. U.S. Pat. No. 4,126,105 issued to Bottcher discloses a boiler assembly comprising a plurality of horizontally aligned hollow sections. U.S. Pat. No. 5,049,324 issued to Morris et al. discloses generally the use of reticulated ceramics as heat exchange media, and U.S. Pat. No. 5,353,749 issued to Seibel et al. discloses generally the use of a series of burners in a large industrial boiler.

Although various ones of the referenced boilers may function satisfactorily for their intended purposes, there is a need for a more compact boiler assembly which tends to optimize combustion, to increase heat transfer and to operate efficiently. The combustion process within the boiler should effectively operate to reduce levels of noxious emissions exhausted to the atmosphere, and the boiler manufacturing and installation costs should provide savings over existing boiler designs.

OBJECTS OF THE INVENTION

With the foregoing in mind, a primary object of the present invention is to provide a novel multi-sectional and modular boiler assembly having heat exchange sections which can readily be assembled with any number of like sections to fit the requirements of a specific heating system.

Another object of the present invention is to provide a unique burner assembly providing a combustion process within the boiler which is quiet, stable and burns fuel efficiently.

A further object of the present invention is to provide an improved boiler heat exchanger which tends to optimize heat transfer so that combustion temperature can be reduced, noxious emissions can be reduced, and efficient use of fuel can be achieved.

SUMMARY OF THE INVENTION

More specifically, the present invention provides a boiler assembly for heating a fluid which circulates through a closed radiator/convector heating system. The boiler assembly has a plurality of burners located in a path of flowing air such that air flows from an upstream direction through, alongside and past the burners. The burners are directed in a downstream direction and are supplied with gaseous fuel by a supply means.

A primary diffuser is located across the path of air upstream from the burners. The primary diffuser evenly distributes the flow of air through and alongside the burners such that a primary fuel-air mixture is created inside each burner. A secondary diffuser is located across the path of air downstream from the burners. The secondary diffuser evenly mixes the primary fuel-air mixture exiting the burners with the air which flowed alongside the burners to create a secondary fuel-air mixture. The secondary fuel-air mixture is ignited to sustain quiet, stable combustion downstream from the burners providing combustion gases to heat the fluid.

In another aspect, the present invention provides a multi-section heat exchanger for transferring heat from the combustion gases to the circulating fluid. The multi-section heat exchanger has a hollow structure for fluid circulation and upper horizontal passageways located downstream from the secondary diffuser. The upper horizontal passageways allow the combustion gases to flow therethrough, whereby heat from the combustion gases is transferred to the fluid through the hollow structure by convection and radiation.

Enhanced heat transfer is accomplished by porous, sponge-like, refractory blocks located centrally in each of the upper horizontal passageways and spaced from the walls of the upper horizontal passageways by fin-like spacer supports. The refractory blocks provide a network of passages for the flowing hot combustion gases to maximize heat transfer while minimizing pressure drop.

The multi-section heat exchanger has a rear section located downstream from the upper horizontal passageways to reverse the flow of the combustion gases downward and back toward the front of the boiler through lower horizontal passageways located below the upper horizontal passageways. The lower horizontal passageways act to further transfer heat from the combustion gases to the fluid by convection before being exhausted from a location near the bottom-front of the boiler.

BRIEF DESCRIPTION OF THE DRAWINGS

The foregoing and other objects, features and advantages of the present invention should become apparent from the following description when taken in conjunction with the accompanying drawings, wherein:

FIG. 2 is a right side elevational, sectional view of FIG. 1 taken on line 2—2 of FIG. 1;

FIG. 2A is a perspective view of a primary diffuser, or air plate showing its orifice pattern;

FIG. 5 is a cross-sectional view taken on line 5—5 of FIG. 2 to illustrate a pinned intermediate section of a heat exchanger in the boiler assembly;

FIG. 6 is a cross-sectional view taken on line 6—6 of FIG. 2 to illustrate a rear section of a heat exchanger in the boiler assembly;

DESCRIPTION OF THE PREFERRED EMBODIMENT

Figure 1:
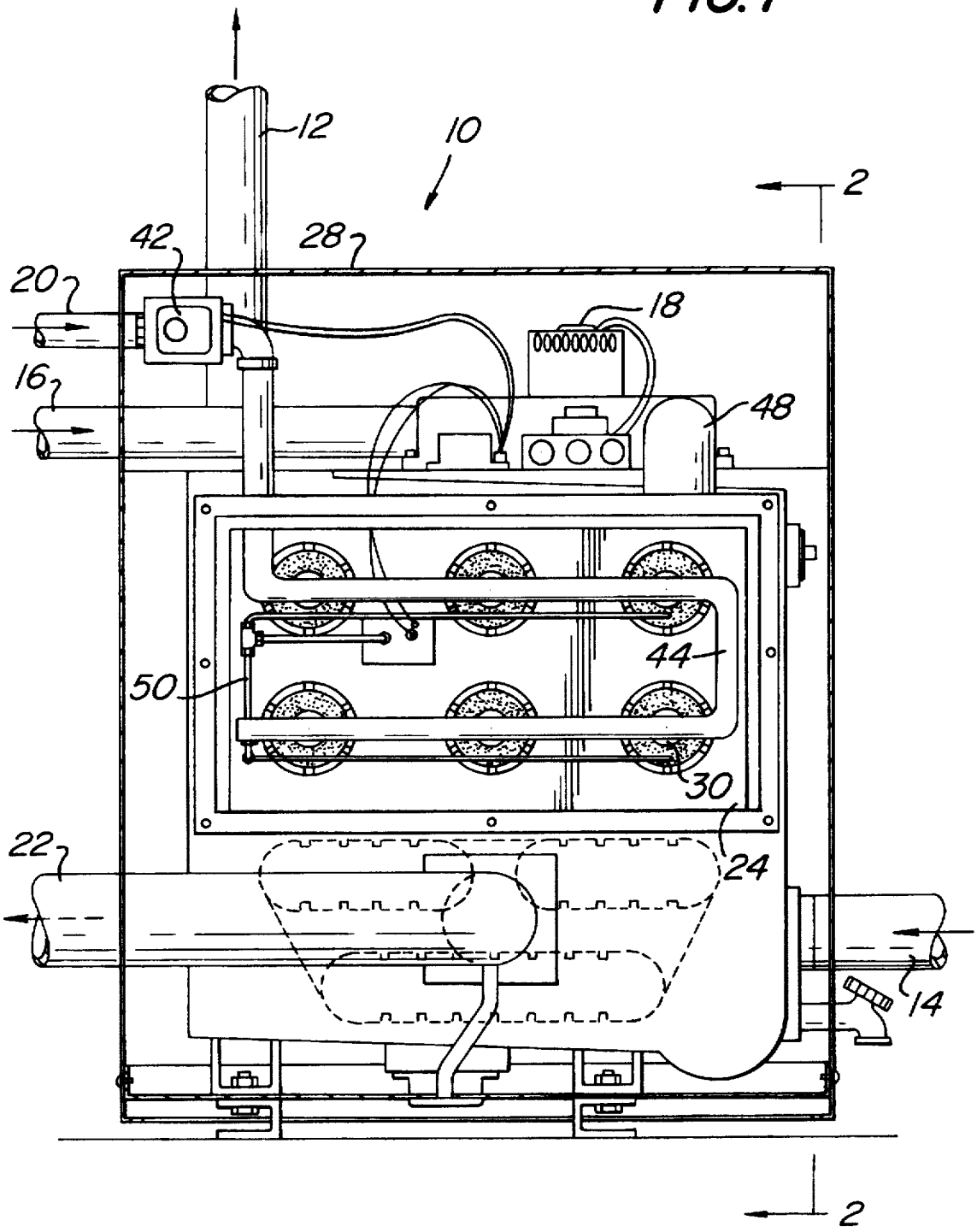
FIG. 1 is an elevational, sectional view of the inside front of a boiler assembly embodying the invention.
Figure 3:
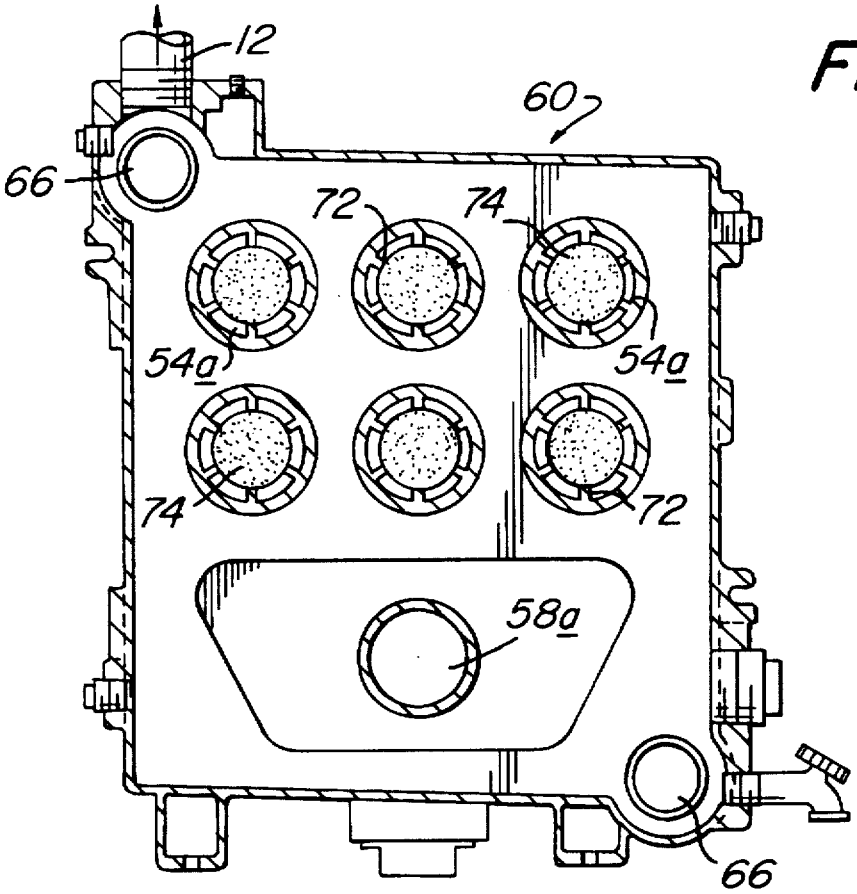
FIG. 3 is a cross-sectional view taken on line 3—3 of FIG. 2 to illustrate a front section of a heat exchanger in the boiler assembly.
Figure 4:
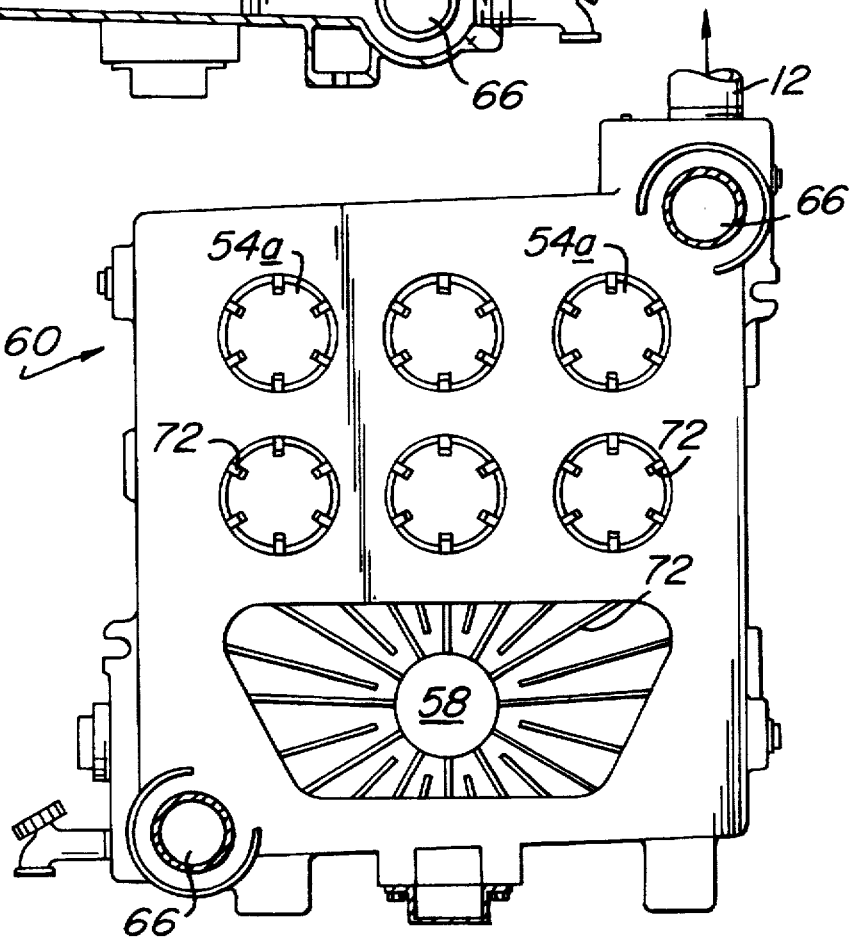
FIG. 4 is a cross-sectional view taken on line 4—4 of FIG. 2 to illustrate a front section of a heat exchanger in the boiler assembly.

FIG. 1 illustrates a boiler 10 according to the present invention. The boiler 10 is intended to be installed as a component of a radiator/convector heating system (not shown) which is used to heat the interior of a commercial building or residential dwelling. A fluid, such as water, is circulated through closed-loop piping to the boiler 10 and is received in the boiler 10 at a fluid inlet 14. The fluid is heated within the boiler 10 and exits the boiler 10 at a fluid outlet 12. The heated fluid is then circulated through the building transferring its heat such as by baseboard radiators. The fluid is then returned to the boiler 10 for further re-heating.

To heat the fluid as it passes through the boiler 10, fuel, such as gas, is supplied to the boiler and is burned. To this end, air at ambient temperature is drawn by a fan 18 into the boiler 10 through an air inlet 16. Simultaneously, gaseous fuel is admitted to the boiler 10 through fuel inlet 20. The air is mixed with the gaseous fuel, as will be discussed in detail later in this application, and is ignited. The hot combustion gases travel through boiler 10 and transfer heat to the fluid. After the heat is removed from the combustion gases, the gases exit the boiler 10 through the flue 22 and are discharged to the atmosphere.

The boiler 10 includes a burner box 24 and a heat exchanger 26 assembled within a housing 28. The components and functions of the burner box 24 and heat exchanger 26 are discussed in detail below.

The Burner Box

As illustrated in FIGS. 1 and 2, the burner box 24 houses a plurality of multiple so-called in-shot burners 30 which burn fuel to create heat. The burner box 24 is located behind a front panel **28*a* of the housing 28. The burner box 24 has a chamber 32 for receiving ambient air through an air supply opening 34. The chamber 32 is located between a front wall 24*a* of the burner box 24 and a primary diffuser, or air plate, 36. The burners 30 are positioned in the burner box 24 between the primary diffuser 36 and a secondary diffuser, or combustion gas plate, 38. The secondary diffuser 38 combines with the burner box 24 which mounts to the front section 60 to form a combustion chamber 40 adjacent the heat exchanger 26**.

As illustrated in FIG. 1, the burner box 24 houses six identical burners 30. Each burner 30 is tubular in shape and has an upstream end **30*a* and a downstream end 30*b* such that each burner 30 is directed toward the heat exchanger 26**.

The supply of gaseous fuel to the burners 30 is regulated by an electric gas valve 42. When the gas valve 42 allows fuel to enter the burner box 24, the fuel flows through a gas manifold 44 and through orifices 46 in the manifold 44. There is one orifice 46 per burner 30. The gaseous fuel exits the orifices 46 coaxial with the longitudinal centerlines of the burners 30 at their upstream ends **30*a***.

The gas valve 42 also regulates a small supply of gaseous fuel to a flame ignition system to initiate combustion. To this end, a so-called zip tube 50 supplies just enough fuel to support small flames adjacent the downstream ends **30*b* of the burners 30** when ignited by a pilot burner (not shown). The pilot burner is a high energy ignitor which is also supplied with gaseous fuel to effect ignition.

On a call for heat, the fan 18 is energized. This causes ambient air to be drawn into the air inlet 16, and compressed and forced into air supply pipe 48. The air supply pipe 48 provides a flow of air into the chamber 32 through the air supply opening 34. The primary diffuser 36 evenly distributes the ambient air as it passes through the primary diffuser 36 into and along side of the burners 30. Preferably, the configuration of orifices in the primary diffuser 36 are arranged as illustrated in FIG. 2A. The orifice configuration is located in the center of the burner box opening and consists of three horizontally disposed rows of laterally spaced orifices which are arranged in a triangular configuration. The uppermost row consists of four relatively small orifices 80; the middle row consists of three relatively medium size orifices 82; and the lowermost row consists of two relatively large orifices 84. A portion of the advancing ambient air enters the burners 30 at their upstream ends **30*a*. The air in the burners 30 mixes with the gaseous fuel supplied by orifices 46 by venturi action to create a primary fuel-air mixture. The remainder of the evenly distributed ambient air passes around the outside of the burners 30**.

After the primary fuel-air mixture exits the burners 30 they are further mixed with the ambient air which passed around the outside of the burners 30. The secondary diffuser 38 aids in the further mixing process to form an overall secondary fuel-air mixture. The secondary diffuser has six equal sized orifices 86 located on the horizontal centerline of the burners. The six orifices direct the fuel-air mixture and mixing air together prior to entering the inlet of the casting flueways.

The final fuel-air mixture, composed of primary and secondary mixtures, is ignited by the small flames above the zip tubes 50 at and beyond the location of the secondary diffuser 38 and in the combustion chamber 40. Thus, heat is created by the burning of the final fuel-air mixture.

The important aspect of the above described burner box 24, is that a proper, pre-determined and consistent fuel-air mixture will effect efficient burning of fuel to sustain quiet, stable combustion. Thus, an efficient burner box can create and sustain higher combustion temperatures with lower energy input. This results in lower operating costs, fuel conservation and less noxious gas emissions.

The Heat Exchanger

Figure 7:
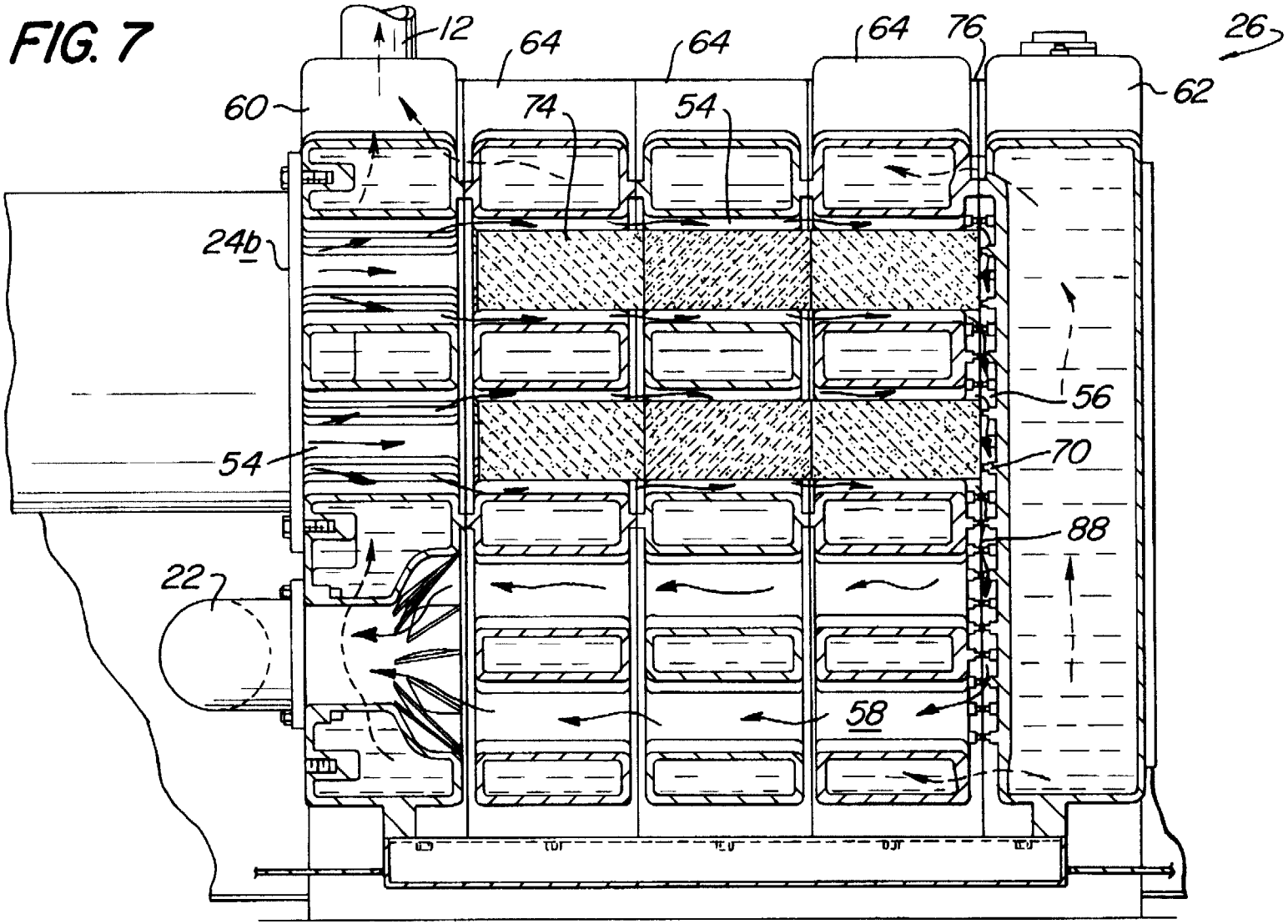
FIG. 7 is a cross-sectional view taken on line 7—7 of FIG. 5 and through the boiler assembly to illustrate the paths of flow of the combustion gases and the circulating fluid.

The heat exchanger 26 provides passages for the circulating fluid and the combustion gases to transfer the heat of combustion to the circulating fluid. To this end, the heat exchanger 26 defines a hollow cavity which receives the circulating fluid at the fluid inlet 14 located on the bottom **26*d* of the heat exchanger 26 adjacent its rear 26*b*. The heat exchanger 26 discharges the circulating fluid at the fluid outlet 12 located on the front 26*c* of the heat exchanger 26 adjacent its top 26*a*. FIG. 7** illustrates with dashed arrows the path of the circulating fluid.

As best seen in FIG. 2, the heat exchanger 26 defines upper horizontal passageways 54 through which the hot combustion gases enter from the burner box 24 and travel toward the rear **26*b* of the heat exchanger 26. The combustion gases then travel downward through a vertical passageway 56 which ends adjacent to lower horizontal passageways 58. The combustion gases travel toward the front 26*c* of the heat exchanger 26 through the lower horizontal passageways 58 which lead to the flue 22 to exhaust the gases to the atmosphere. FIG. 7 illustrates with solid arrows the path of the combustion gases through the heat exchanger 26. Along the entire trip, the combustion gases release heat to the heat exchanger 26** and to the circulating fluid therein by convection and radiation.

Figure 8:
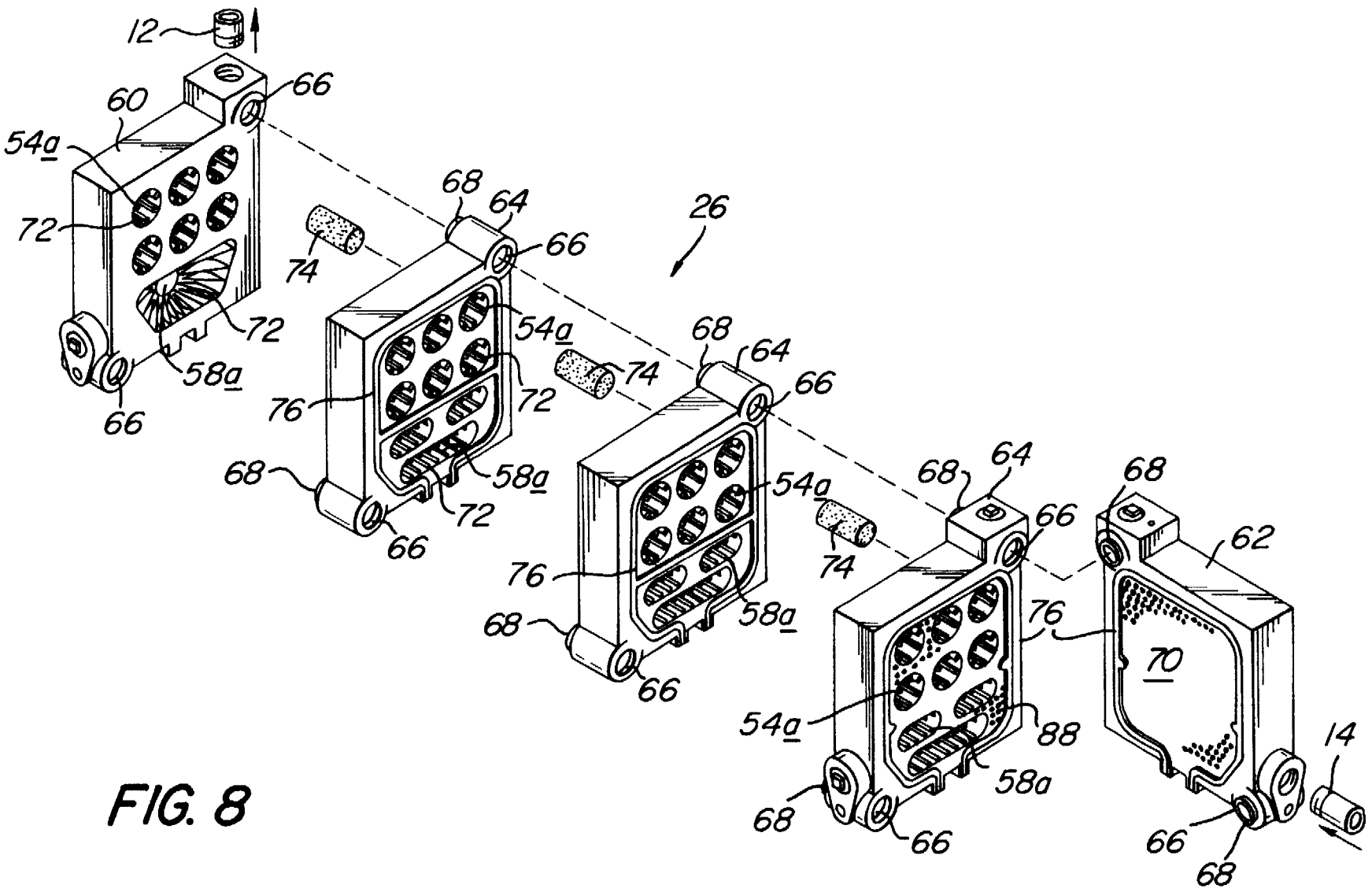
FIG. 8 is an exploded view of the front, intermediate, pinned intermediate, and rear sections of the heat exchanger in the boiler assembly.

The heat exchanger 26 is of modular construction so that it can be readily adapted to accommodate various heating system capacities. To this end, the heat exchanger 26 comprises a front section 60, a rear section 62 and any number of intermediate sections 64. As illustrated in FIGS. 2 and 8, three intermediate sections 64 are used; however, depending on the specific heating system requirements, up to twenty intermediate sections 64 can be installed. All sections 60, 62 and 64 are hollow and manufactured of cast iron.

The front section 60 is located adjacent a back flange **24*b* of the burner box 24; whereas, the rear section 62 is the section most remote from the burner box 24. Each of the sections 60, 62 and 64** are filled with fluid which can circulate therethrough.

The fluid is first received by the rear section 62 via fluid inlet 14. As seen in FIG. 6, the rear section 62 has a pair of ports 66 which provide passages for the fluid to circulate to the adjacent intermediate section 64. Likewise, as shown in FIG. 5, all the intermediate sections 64 have ports 66 which communicate with the adjacent intermediate section 64, or the front section 60. Finally, the front section 60 has a pair of ports 66 which receives fluid from the adjacent intermediate section 64 and allows the fluid to exit the heat exchanger 26 through the fluid outlet 12.

A tight seal is created between sections 60, 62 and 64 to provide a leak-free passage of the fluid. Nipples 68 made of cast iron, or steel, are provided on the rear section 62, and on one side of the intermediate sections 64, for insertion into the mating port 66 on the adjacent section. When the sections are compressed the leak-free seals are created and the heat exchanger assembly is complete. The sections remain compressed by the use of horizontally positioned tension rods (not shown) bolted to the sides of the sections as is common in the art.

The front section 60 and the intermediate sections 64 have a plurality of passages extending horizontally through their hollow structure to provide a sealed path for the combustion gases. The top halves of the front section 60 and the intermediate sections 64 each have six passages **54*a*, one for each burner 30. When the sections are aligned and compressed together, the passages 54*a* form six upper horizontal passageways 54 for the combustion gases as they exit the burner box 24**.

The rear section 62 is designed to reverse the flow of the combustion gases toward the front **26*c* of the heat exchanger 26. To this end, the rear section 62 has a pinned surface 70 for receiving the combustion gases after exiting the upper horizontal passageways 54 and for deflecting the flow of the combustion gases downward. The intermediate section 64 confronting the rear section 62 also can have a pinned surface 88 as shown in FIG. 8**.

The bottom halves of the front section 60 and the intermediate sections 64 have passages **58*a* for receiving the flow of combustion gases after being reversed by the rear section 62. As shown in the drawings, the intermediate sections 64 have three oval shaped passages 58*a*, while the front section 60 has a funnel-shaped passage 58*a* which leads to the flue 22. The flue 22** provides a path for flowing the gases out of the building.

Porous cylindrical, or square, refractory blocks 74, such as reticulated ceramic, are located centrally in the upper horizontal passageways 54 in the intermediate sections 64 to provide thermal inertia and to enhance the transfer of heat from the combustion gases to the circulating fluid. The refractory blocks 74 are spaced from the walls of the upper horizontal passageways 54 by fins 72. The combustion gases flow through internal passages in the refractory blocks 74. The internal passages in the sponge-like structure of the refractory blocks 74 minimize the pressure drop of the flowing gases through passages **54*a*. The refractory blocks 74** absorb heat.

The heat exchanger 26 of the present invention includes other concepts which aid in the efficient transfer of heat. For example, the passages **58*a* in the front section 60 and the intermediate sections 64 are provided with fins 72 which aid in conduction of heat to the circulating fluid. The rear section 62 contains the coolest of the circulating fluid; therefore, as the combustion gases travel downward along the vertical passageway 56 defined by the pinned surface 70 of the rear section 62 and the pinned surface 88 of the pinned intermediate section 64, further heat is removed from the gases and transferred to the fluid. The lower horizontal passageways 58 provide the final heat transfer by convection. When the combustion gases are released outdoors, the temperature of the combustion gases is significantly reduced to reduce the amount of noxious emissions. In addition, gaskets 76 are provided between adjacent sections 60, 62 and 64 and between the top and bottom halves of sections 60 and 64**, to ensure sealed passageways.

The above described heat exchanger 26 provides an extremely compact design which optimizes heat transfer.

In view of the foregoing, it should be apparent that the present invention now provides a boiler of modular construction capable of being fitted with a selected number of heat exchange sections to suit the requirements of the specific heating system in which it is to be installed. The boiler provides a fuel burner assembly which is quiet, stable and fuel efficient. The boiler optimizes heat transfer so that a desirable combustion temperature can be maintained, noxious emissions can be reduced, and efficient use of fuel can be achieved.

While a preferred embodiment of the present invention has been described in detail, various modifications, alterations, and changes may be made without departing from the spirit and the scope of the present invention as defined in the appended claims.

We claim:

1. A boiler assembly for heating a fluid which circulates through a sealed radiator/convector heating system, comprising:

a plurality of burners, said burners being located in a path of flowing air such that air flows from an upstream direction through, alongside and past said burners, said burners being directed in a downstream direction;

means for supplying gaseous fuel to said burners;

a primary diffuser located across said path of air upstream from said burners for evenly distributing the flow of air through and alongside said burners such that a primary fuel-air mixture is created inside each said burner; and a secondary diffuser located across said path of air downstream from said burners for evenly mixing said primary fuel-air mixture exiting said burners with the air which flowed alongside said burners to create a secondary fuel-air mixture;

whereby quiet, stable combustion of said secondary fuel-air mixture can be sustained downstream from said burners providing combustion gases to heat the fluid.

2. A boiler assembly according to claim 1, further comprising a burner box which houses said burners, said primary diffuser and said secondary diffuser, said burner box having a combustion chamber adjacent said secondary diffuser and opposite said burners where said secondary fuel-air mixture burns.

3. A boiler assembly according to claim 2, further comprising a heat exchanger located adjacent said burner box for receiving the combustion gases and transferring heat from the combustion gases to the circulating fluid, said heat exchanger having a hollow structure for fluid to circulate therethrough, and said heat exchanger having a passageway located adjacent said combustion chamber for allowing the flow of the combustion gases therethrough, whereby heat from the combustion gases is transferred to the fluid through said hollow structure by convection and radiation.

4. A boiler assembly according to claim 3, further comprising a porous refractory block located in said passageway.

5. A boiler assembly according to claim 4, wherein said heat exchanger includes a rear section located downstream from said passageway, for reversing the flow of the combustion gases into a lower heat exchanger passageway.

6. A boiler assembly according to claim 5, wherein said heat exchanger includes a front section located adjacent said combustion chamber of said burner box and forming at least a part of said passageway and said lower passageway.

7. A boiler assembly according to claim 6, wherein said heat exchanger includes at least one intermediate section located between said front section and said rear section, said at least one intermediate section forming at least a part of said passageway and said lower passageway.

8. A boiler assembly according to claim 7, wherein said passageway and said lower passageway are lined with fins to enhance the conduction of heat.

9. A boiler assembly according to claim 8, wherein said rear section has a pinned surface which is impinged upon by the combustion gases.

10. A boiler assembly according to claim 9, wherein said front section and said intermediate section have a nipple-port connection to allow the fluid to circulate from said intermediate section to said front section; and wherein said rear section and said intermediate section have a nipple-port connection to allow the fluid to circulate from said rear section to said intermediate section.

11. A boiler assembly according to claim 10, wherein said rear section has an inlet for receiving the circulating fluid, and wherein said front section has an outlet providing discharge of the circulating fluid.

12. A boiler assembly according to claim 11, wherein said front section and said intermediate section have gaskets therebetween so that said passageway and said lower passageway are sealed tight from each other and from a surrounding environment, and wherein said rear section and said intermediate section have a gasket therebetween to seal the combustion gases from the surrounding environment.

13. A boiler assembly for heating a fluid which circulates through a sealed radiator/convector heating system, comprising:

a burner box having an air chamber, a plurality of burners and a combustion gas chamber, said air chamber and said burners being separated by a primary diffuser, and said burners and said combustion gas chamber being separated by a secondary diffuser;

air supplying means for supplying ambient air to said air chamber to create a path of flowing air through said air chamber, through and around said burners, and into said combustion gas chamber;

gaseous fuel supplying means for supplying gaseous fuel to said burners;

said primary diffuser being positioned substantially perpendicular to said path of air, said primary diffuser having a plurality of apertures therein so that the flowing air is evenly distributed to and around said burners such that a primary fuel-air mixture is created inside each said burner;

said secondary diffuser being positioned substantially perpendicular to said path of air, said secondary diffuser having a plurality of apertures therein to evenly mix said fuel-air mixture exiting said burners with the air which flowed around said burners to create a secondary fuel-air mixture; and ignition means for igniting said secondary fuel-air mixture, wherein combustion takes place in said combustion gas chamber in a sustainable quiet and stable manner.

14. A boiler assembly according to claim 13, further comprising a multi-sectional heat exchanger for receiving the combustion gases from said combustion gas chamber and for transferring the heat of the combustion gases to the fluid passing through said heat exchanger.

15. A boiler assembly according to claim 14, wherein said multi-sectional heat exchanger includes a rear section having an inlet for the circulating fluid, a front section having an outlet for the circulation fluid, and at least one intermediate section located between said front section and said rear section, said front, back and intermediate sections having passages for the flow of fluid therebetween.

16. A boiler assembly according to claim 15, wherein said front section is adjacent said combustion gas chamber, wherein said front and intermediate sections define an upper horizontal passageway for the combustion gas to pass therethrough, and wherein a reticulated ceramic block is located in said upper horizontal passageway in said intermediate sections.

17. A boiler assembly according to claim 16, wherein said upper horizontal passageway is lined with fins to support said reticulated ceramic block.

18. A boiler assembly according to claim 17, wherein said rear section has a pinned surface impinged on by the combustion gases as they exit said upper horizontal passageway, and wherein the combustion gases travel downwardly along said pinned surface.

19. A boiler assembly according to claim 18, wherein said front and intermediate sections define a lower horizontal passageway for receiving the flow of the combustion gases from said pinned surface and discharging the combustion gases to a flue.

20. A boiler assembly for heating a fluid which circulates through a sealed radiator/convector heating system, comprising:

at least one burner for burning a gaseous fuel to create hot combustion gases;

a multi-sectional heat exchanger for receiving the hot combustion gases from said burner and for transferring the heat of the combustion gases to the fluid passing through said heat exchanger;

said multi-sectional heat exchanger including a rear section having an inlet for the circulating fluid, a front section having an outlet for the circulation fluid, and at least one intermediate section located between said front section and said rear section, said front, back and intermediate sections having ports for the flow of fluid therebetween; and said front and intermediate sections defining a horizontal passageway for the combustion gases, said horizontal passageway having a plurality of fins for supporting a refractory block within said horizontal passageway.

21. A boiler according to claim 20, further comprising a burner box having an air chamber, a plurality of burners and a combustion gas chamber, said air chamber and said burners being separated by a primary diffuser, and said burners and said combustion gas chamber being separated by a secondary diffuser; air supplying means for supplying ambient air to said air chamber to create a path of flowing air through said air chamber, through and around said burners, and into said combustion gas chamber; gaseous fuel supplying means for supplying gaseous fuel to said burners; said primary diffuser being positioned substantially perpendicular to said path of air, said primary diffuser having a plurality of apertures therein so that the flowing air is evenly distributed to and around said burners such that a primary fuel-air mixture is created inside each said burner; said secondary diffuser being positioned substantially perpendicular to said path of air, said secondary diffuser having a plurality of apertures therein to evenly mix said primary fuel-air mixture exiting said burners with the air which flowed around said burners to create a secondary fuel-air mixture; and ignition means for igniting said fuel-air mixture; wherein combustion takes place in said combustion gas chamber in a sustainable quiet and stable manner.

* * * * *